United States Patent [19]

Fox

[11] Patent Number: 5,023,956

[45] Date of Patent: Jun. 18, 1991

[54] ELONGATED ARTICLE OF APPAREL

[75] Inventor: Flo Fox, New York, N.Y.

[73] Assignee: Peter Weiss, New York, N.Y.

[21] Appl. No.: 487,352

[22] Filed: Feb. 28, 1990

[51] Int. Cl.[5] ..... A41F 9/00

[52] U.S. Cl. ..... 2/338; 2/311; 2/321; 2/323; 40/586

[58] Field of Search ..... 2/170, 171.1, 171.2, 2/310, 311, 312, 338, 321, 322, 247, 250; 40/586, 596, 618; 446/27, 28

[56] References Cited

U.S. PATENT DOCUMENTS

| | | | |
|---|---|---|---|
| 226,658 | 4/1880 | Graydon | 2/338 X |
| 689,352 | 12/1901 | Buffington | 2/338 |
| 802,558 | 10/1905 | Gaisman | 2/332 |
| 1,553,916 | 9/1925 | Rose | 2/338 |
| 1,718,622 | 6/1929 | Zeller | 40/618 |
| 1,756,547 | 4/1930 | Hansen | 40/618 |
| 1,920,061 | 7/1933 | Carr | 2/321 |
| 1,963,309 | 6/1934 | Muller | 2/338 |
| 2,192,883 | 3/1940 | Forstner | 40/618 |
| 2,321,808 | 6/1943 | Govan | 2/321 |
| 2,339,239 | 1/1944 | Carmichael | 2/311 X |
| 2,427,119 | 9/1947 | Bensel | 2/338 |
| 2,821,635 | 1/1958 | Bailen | 2/338 |
| 2,871,485 | 2/1959 | Greco | 2/247 |
| 3,055,133 | 9/1962 | Anderson | 40/586 |
| 3,078,469 | 2/1963 | Lynam | 2/338 |
| 3,214,852 | 11/1965 | Ford et al. | 40/586 X |
| 3,521,798 | 7/1970 | Hill | 2/338 X |
| 4,062,066 | 12/1977 | Weiss | 2/322 |
| 4,144,594 | 3/1979 | Chapman | 2/338 |
| 4,151,936 | 5/1979 | Hawkes | 2/321 X |
| 4,340,976 | 7/1982 | Wright | 2/338 |
| 4,446,574 | 5/1984 | Kalomeris | 2/338 |
| 4,521,923 | 6/1985 | Mackey | 2/338 |
| 4,557,215 | 12/1985 | Petersson | 2/170 X |
| 4,581,271 | 4/1986 | Gordon | 2/311 X |
| 4,602,390 | 7/1986 | Morera et al. | 2/247 |
| 4,918,758 | 4/1990 | Rendina | 2/171 |
| 4,924,613 | 5/1990 | Levin | 40/586 |

FOREIGN PATENT DOCUMENTS

| | | | |
|---|---|---|---|
| 2509144 | 1/1983 | France | 2/338 |
| 526150 | 5/1985 | Italy | 2/322 |

*Primary Examiner*—Werner H. Schroeder
*Assistant Examiner*—Jeanette E. Chapman
*Attorney, Agent, or Firm*—Jordan and Hamburg

[57] ABSTRACT

An elongated article of apparel, such as a waist belt, is constituted of strips of self-cohesive, pliable transparent plastic which form a well sealed enveloping structure which may be manually unsealed and opened out for the insertion of flat decorative material, such as photographs, and the manually be closed again and well resealed.

6 Claims, 1 Drawing Sheet

ELONGATED ARTICLE OF APPAREL

BACKGROUND OF THE INVENTION

This invention relates to an elongated article of apparel adapted to at least substantially encircle a portion of the body of a wearer of the article. The article of apparel is typically a belt, suspenders, headband, wristband or necktie. More particularly, the article of apparel of this invention comprises transparent plastic sheeting so that photographs or other flat decorative matter can be inserted therein for display.

In U.S. Pat. No. 1,060,229, there has been proposed an article of apparel consisting of an elongated body, preferably of soft leather, having a series of spaced openings formed along its length and a strip of transparent celluloid secured against one face of the body over the openings and formed with spaced longitudinal flanges for receiving a plurality of display cards, the edges of the body being inturned upon the flanges of the strip, the body and inturned edges thereof being secured to the strip and its flanges by a series of stitchings. The spaced openings are not sealed. This permits the cards to slip out partially, which is detrimental to the appearance of the article of apparel, or to be lost altogether and also permits the interior face of the celluloid to become soiled. Moreover, celluloid is flexible but not pliable. Consequently, when the article of apparel is one which, like a belt, encircles a portion of the body of the wearer, the stressing of the celluloid resulting from the curvature imparted to the article of apparel when it encircles a body part of the wearer will cause the openings in the celluloid to gap, aggravating the aforementioned problems.

In U.S. Pat. No. 2,596,884, there has been proposed a waist belt having front and rear layers at least one of which extends substantially the full length of the belt substantially throughout its width. The layers are secured together along narrow spaced vertically extending areas to form a plurality of pockets at closely spaced positions along a substantial length of the belt. The pockets have openings adapted to receive inserts. The front layer of the belt is sufficiently transparent to make the inserts visible against the inner faces of the front layer. The layers are joined by heat sealing or by cementing with the use of solvent or cement. Rubber hydrochloride or polymeric vinyl chloride/vinyl acetate containing a high proportion of plasticizer are suggested plastics but the patent indicates that the choice of plastic is not part of the invention. The pockets do not seal, facilitating displacement or loss of the inserts and soiling of the interior of the pockets.

SUMMARY OF THE INVENTION

It is an object of the invention to provide an elongated article of apparel adapted to at least substantially encircle a portion of the wearer's body and display flat decorative matter inserted therein which avoids the disadvantages of the prior art.

Other objects and advantages of the invention will be apparent from the following descriptions of the invention.

According to the invention, there is provided an elongated article of apparel adapted to at least substantially encircle a portion of the body of a wearer of the article of apparel and display flat decorative matter inserted therein, which holds the decorative matter securely and sealed against the entry of soil. The article of apparel is constituted of three substantially longitudinally coextensive strips of self-cohesive, pliable plastic sheeting. A first of the strips is transparent and has a surface forming an obverse face of the article of apparel and has mutually opposed lateral edges. The second and third strips each have a lateral edge attached to a respective one of the lateral edges of the first strip. The second and third strips are each narrower than the first strip and each have a free lateral edge. The combined widths of the second and third strips is greater than the width of the first strip so that the second and third strips have mutually overlapping lateral portions contiguous with their respective free lateral edges. The first, second and third strips thereby form an enveloping structure having a transparent obverse wall. The pliability of the sheeting permits the overlapping portions of the second and third strips to be manually peeled away from each other thereby to provide access to the interior of the enveloping structure for insertion or removal of flat decorative matter and then to be mutually overlapped again. The self-cohesiveness of the plastic sheeting causes the overlapping portions to cohere sufficiently to remain sealed when not being subjected to manual peeling.

BRIEF DESCRIPTION OF THE DRAWINGS

The invention will be further described by reference to a preferred embodiment as illustrated in the drawings, in which.

DETAILED DESCRIPTION OF A PREFERRED EMBODIMENT

Figure 1:
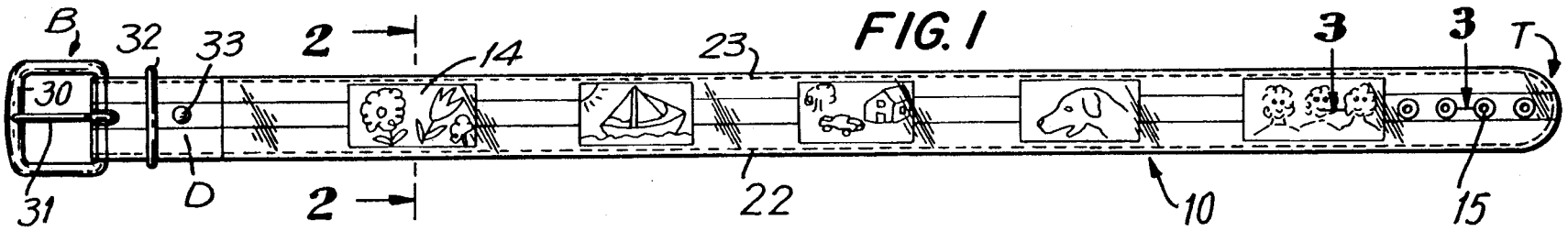
FIG. 1 is a plan view of a waist belt according to the invention.
Figure 2:
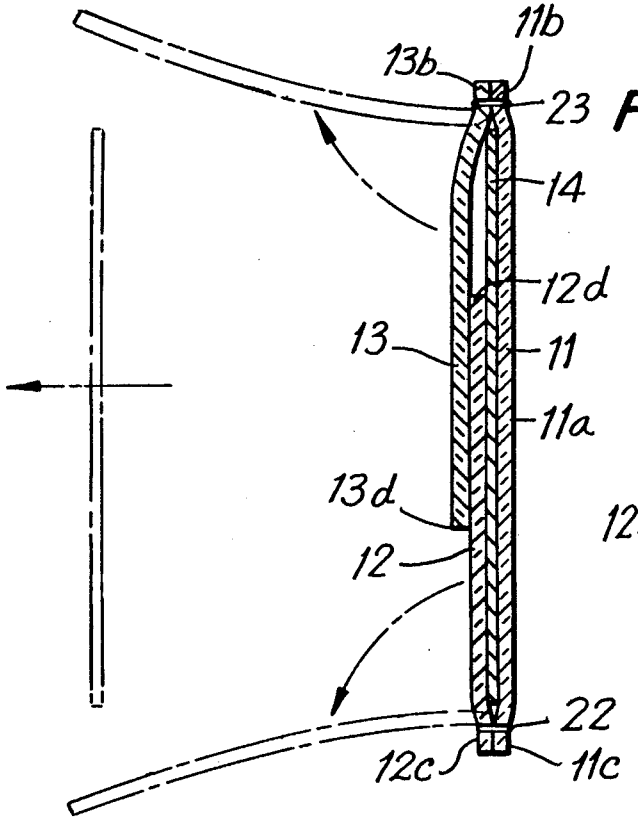
FIG. 2 is a sectional view thereof on section line 2'2 of FIG. 1.
Figure 3:
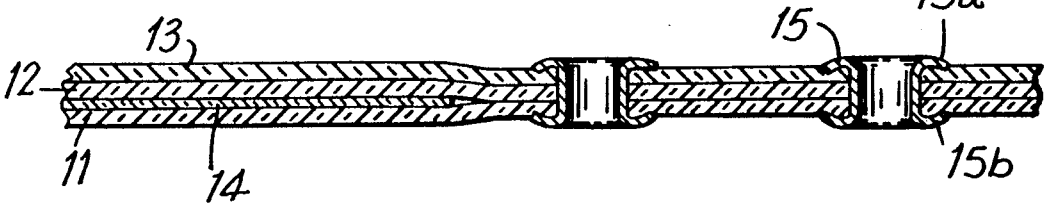
FIG. 3 is a sectional view thereof on section line 3—3 of FIG. 1.

A waist belt 10 according to the invention is constituted of three substantially longitudinally coextensive strips of self-cohesive, pliable transparent plastic sheeting, 11, 12 and 13. Self-cohesiveness and pliability of the sheeting are essential. "Pliability" is a common term and should require no explanation for those of ordinary skill in the plastics fabrication arts. "Self-cohesiveness" refers to the property of pliable sheets of some plastics to cohere to each other. This is not a result of static electricity. Rather, it is a not well understood phenomenon presumably related to the surface molecular structure of the plastic. It has been found that pliable plastic sheeting consisting essentially of polyvinyl chloride, i.e., unplasticized polyvinyl chloride, is excellent in self-cohesiveness and, hence, is a preferred material for the practice of the present invention. This material, 100% polyvinyl chloride sheeting, is sometimes referred to in the trade as "virgin vinyl film sheeting."

The sheeting does not have adequate self-cohesiveness unless it is relatively soft. Suitably soft sheeting may be defined as sheeting having a Durometer of 1S to 6S, a Durometer of 4S being particularly preferred. Pliability and softness are related. A too hard material inherently will not be pliable. Pliability of unplasticized polyvinyl chloride sheeting is effected by ambient temperature and humidity, particularly the former. Low temperatures decrease pliability of the polyvinyl chloride sheeting. Durometer determinations are, by definition, made at room temperature. The hereinabove suggested Durometer ranges are such that the polyvinyl chloride sheeting will still be pliable when exposed to temperatures typical of temperate climate winters, e.g., generally no lower than about 0° F. and rarely below −10° F. In use, the articles of apparel are rarely exposed to such low temperatures as they are generally worn close to the body of a person wearing outerwear thereover.

In the drawings strips 11, 12 and 13 are illustrated as being of the same thickness. In practice, it is sometimes desirable, for product economy, durability and integrity, that the strip 11, the outer face 11*a* of which is the obverse face of the article 10, be of heavier gauge than the strips 12 and 13. For example, in one proposed commercial embodiment of the invention, the strip 11 is 0.030 gauge (i.e., 0.030" thick) whereas the strips 12 and 13 are 0.018 gauge (i.e., 0.018" thick).

To mutually opposed lateral edges 11*b* and 11*c* of the strip 11 are stitched respective lateral edges 13*b* and 12*c* of the strips 13 and 12 by means of respective rows of stitches 23 and 22 (referred to in the waist belt trade as "top stitching") which in fact are constituted of one seam of stitching extending also around the tip of the belt. The thread is preferably 100% mercerized cotton. The sewing machine is preferably set at a medium thread tension setting. The result is a 3 to 5% residual shrinkage of the stitches, which assures that the stitches tightly seal together the edges of the strips. For environmental and safety reasons, stitching is preferred to heat sealing. Heat sealing of polyvinyl chloride results in emission of HCl, CO and $CO_2$, requiring special venting.

Strips 12 and 13 are each narrower than strip 11 but have combined widths greater than the width of the strip 11. The result is that the strips 12 and 13 have mutually overlapping and cohering lateral portions contiguous with their respective free lateral edges 12*d* and 13*d* and the strips 11, 12 and 13 form a transparent enveloping structure. The pliability of the sheeting permits the mutually cohering overlapping portions of the strips 12 and 13 to be peeled away from each other thereby to provide access to the interior of the enveloping structure for the insertion or removal of flat decorative matter, such as photographs 14, and then manually to be mutually overlapped and pressed into mutual coherence again. The self-cohesiveness of the plastic sheeting causes the overlapping portions, particularly with the assistance of finger pressure, to cohere sufficiently to remain sealed when not being subjected to the aforementioned manual peeling.

The waist belt 10 otherwise comprises conventional structure and hardware, namely, near the tip T several punched holes reinforced by metal eyelets 15, the holes being equally spaced in the lengthwise direction of the belt and being equidistant from opposed lateral edges of the belt, a buckle B consisting of a frame 30 and a tongue or prong 31 for being received in a selected metal eyelet 15, a keeper 32 for receiving the tip T of the belt, and one or more metal rivets 33 for fastening a doubled under portion D of the belt which secures the buckle B and the keeper 32. The strips 12 and 13 overlap in a sufficient width so that the punched holes pass through all three strips 11, 12 and 13 and all three strips 11, 12 and 13 are sandwiched between opposed annular flanges 15*a* and 15*b* of the eyelets 15.

It is not intended that the invention be limited to the specific embodiment herein illustrated. For example, in principle, plastic strips 12 and 13 need not be transparent and may be pigmented or dyed. However, the introduction of pigment or dye may decrease the self-cohesiveness of the strips and, moreover, obscure to the eyes of a prospective purchaser the decorative potential of the article.

What I claim is:

1. An elongated article of apparel adapted to at least substantially encircle a portion of the body of a wearer of the article of apparel, comprising three substantially longitudinally coextensive elongated strips of self-cohesive, pliable plastic sheeting, a first of the strips being transparent and having a surface forming an obverse face of the article of apparel and having mutually opposed later edges, the second and third strips each having a lateral edge attached to a respective one of the lateral edges of the first strip, the second and third strips each being narrower than the first strip and each having a free lateral edge, the combined widths of the second and third strips being greater than the width of the first strip whereby the second and third strips have mutually overlapping lateral portions, contiguous with their respective free lateral edges, the first, second and third strips thereby forming a transparent enveloping structure, the pliability of the sheeting permitting the overlapping portions of the second and third strips to be manually peeled away from each other thereby to provide access to the interior of the enveloping structure for the insertion or removal of flat decorative matter and then to be mutually overlapped again and the self-cohesiveness of the plastic sheeting causing the overlapping portions to cohere sufficiently to remain sealed when not being subjected to said manual peeling.

2. An elongated article of apparel according to claim 1, in which said attached lateral edges are stitched together.

3. An elongated article of apparel according to claim 1, in which said stitches are formed of cotton thread.

4. An elongated article of apparel according to claim 1, in which said sheeting consists essentially of polyvinyl chloride.

5. An elongated article of apparel according to claim 2, in which said sheeting consists essentially of polyvinyl chloride.

6. An elongated article of apparel according to claim 3, in which said sheeting consists essentially of polyvinyl chloride.

* * * * *